US007670084B2

(12) United States Patent
Aristeo, Jr.

(10) Patent No.: US 7,670,084 B2
(45) Date of Patent: Mar. 2, 2010

(54) PRECASTING OF FABRICATED FLUMES FOR MACHINING COOLANT SYSTEMS

(75) Inventor: Agostino Aristeo, Jr., Novi, MI (US)

(73) Assignee: Aristeo Construction, Livonia, MI (US)

( * ) Notice: Subject to any disclaimer, the term of this patent is extended or adjusted under 35 U.S.C. 154(b) by 73 days.

(21) Appl. No.: 11/550,932

(22) Filed: Oct. 19, 2006

(65) Prior Publication Data

US 2008/0095582 A1 Apr. 24, 2008

(51) Int. Cl.
*E02B 9/04* (2006.01)

(52) U.S. Cl. ..... 405/119; 52/220.2; 137/362

(58) Field of Classification Search ..... 405/119, 405/36, 52, 118; 52/220.1, 220.2; 137/343, 137/356, 357, 362

See application file for complete search history.

(56) References Cited

U.S. PATENT DOCUMENTS

| | | | | |
|---|---|---|---|---|
| 4,749,307 | A | 6/1988 | Huffaker et al. | |
| 5,061,116 | A | 10/1991 | Monks | |
| 5,213,438 | A | 5/1993 | Barenwald | |
| 5,529,436 | A | 6/1996 | Meyers | |
| 2004/0005194 | A1 * | 1/2004 | Williams et al. | 405/43 |
| 2004/0136785 | A1 * | 7/2004 | Gunter | 405/118 |

* cited by examiner

*Primary Examiner*—Tara Mayo-Pinnock
(74) *Attorney, Agent, or Firm*—Brooks Kushman P.C.

(57) ABSTRACT

A method and apparatus for constructing machinery flumes couples precast, fabricated sections of flume having a channel lining in a concrete cast. The sections are assembled to seal end to end forming a continuous trough in which assembly work is contained to reduce installer exposure, reduce field installation time and reduce construction costs for flume systems. Preferably, an end of a lining extends beyond the cast sheath for connection with an overlapped portion of an adjacent precast section's lining.

15 Claims, 6 Drawing Sheets

PRECASTING OF FABRICATED FLUMES FOR MACHINING COOLANT SYSTEMS

BACKGROUND OF THE INVENTION

1. Field of the Invention

The present invention relates to a method and apparatus for constructing flumes for containment and transfer of liquids and solids such as residual metal chips below manufacturing operations including machining.

2. Background Art

Many machining operations require a means to remove metal chips, grinding particulates and coolants from machine tools and transfer them to coolant filtration systems. A steel lined trench open to atmosphere, known as a flume, functions as conduit collecting coolants and metal chips. The trench is encased with concrete walls below the machinery to provide restraint against lateral forces, restraint against ground forces exerted from soils, and compression strength for vertical loads imposed by the machines. The conventional practice of installing flumes requires construction of a steel liner and supporting material in an excavation, then encasing the fabrication with concrete in the excavation.

In a previously known installation, after the contractor lays out the center line, a large excavation is made for flume elevation including the necessary size enlargement for working space adjacent the flume and the wall shaping that reinforces the perimeter. In addition, the shaping of the excavation may be relied upon for controlling the slope for drainage of the flume, or is at least complementary to the required flume grade. Numerous cut angle irons form stakes, for example, a frame of 2"×2"×¼" angle iron stakes are driven into the base of the excavation. Shoes are then welded on numerous stakes by laborers in the bottom of the excavation. The elevation required is marked at the top of stakes, and each stake is then cut to the desired height. The flume liner, generally made of metal sheets formed in a channel, and tied to reinforcement rods, usually made of steel.

The flume metal sheets must be carried in the excavation and set by aligning the flume with braces and welding to the stakes. Welding flume joints requires both outside and inside welds on double walled containment flumes, and the outer layer welds may be performed within the excavation. Then, the contractor begins encasing the bottom of flume with concrete. The contractor either forms an exterior wall of the flume for receiving concrete, or constructs a form, places it in the excavation and after curing the cast, removing the pouring form wall, then completing encasement of the flume with additional concrete. Also, the introduction of backfill into the excavation may lift the flume to proper elevation. Substantial time, costs, energy and risks of loss have been encountered in labor performed to excavate, build and install previous flume arrangements.

SUMMARY OF THE INVENTION

The present invention overcomes the above mentioned disadvantages with an improved methods and apparatus for fabricating and for installing flumes for machining coolant systems used in manufacturing machining operations. The invention provides processes for prefabrication of cast flume sections and processes for installation of concrete encased flume sections. In addition, at least one embodiment of a method of flume prefabrication, and at least one embodiment of a method of installation, avoid the need for personnel to enter the excavation exteriorly of the flume and reduces excavation requirements.

The present invention reduces labor, excavation and material costs for field installation, and eliminates the assembly and removal of forms in excavations for cast-in-place flume encasement. A preferred embodiment of flume sections, a preferred method embodiment of section fabrication and a preferred method embodiment of installation contribute to reducing worker exposure in below-grade excavations, reducing the size and time required for excavations, and reducing on-site concrete setting and curing time. The new methods and apparatus permit immediate incasing that may include backfill and compaction of soils, reduce demolition time required for previously known systems, and may be readily adapted for disassembly and for reutilization of precast flume sections for future machining lines.

BRIEF DESCRIPTION OF THE DRAWINGS

The present invention will be better understood by reference to the following detailed description of a preferred embodiment, when read in conjunction with the accompanying drawing, in which like reference characters refer to like parts throughout the views and in which.

DETAILED DESCRIPTION OF THE PREFERRED EMBODIMENT(S)

Figure 1:
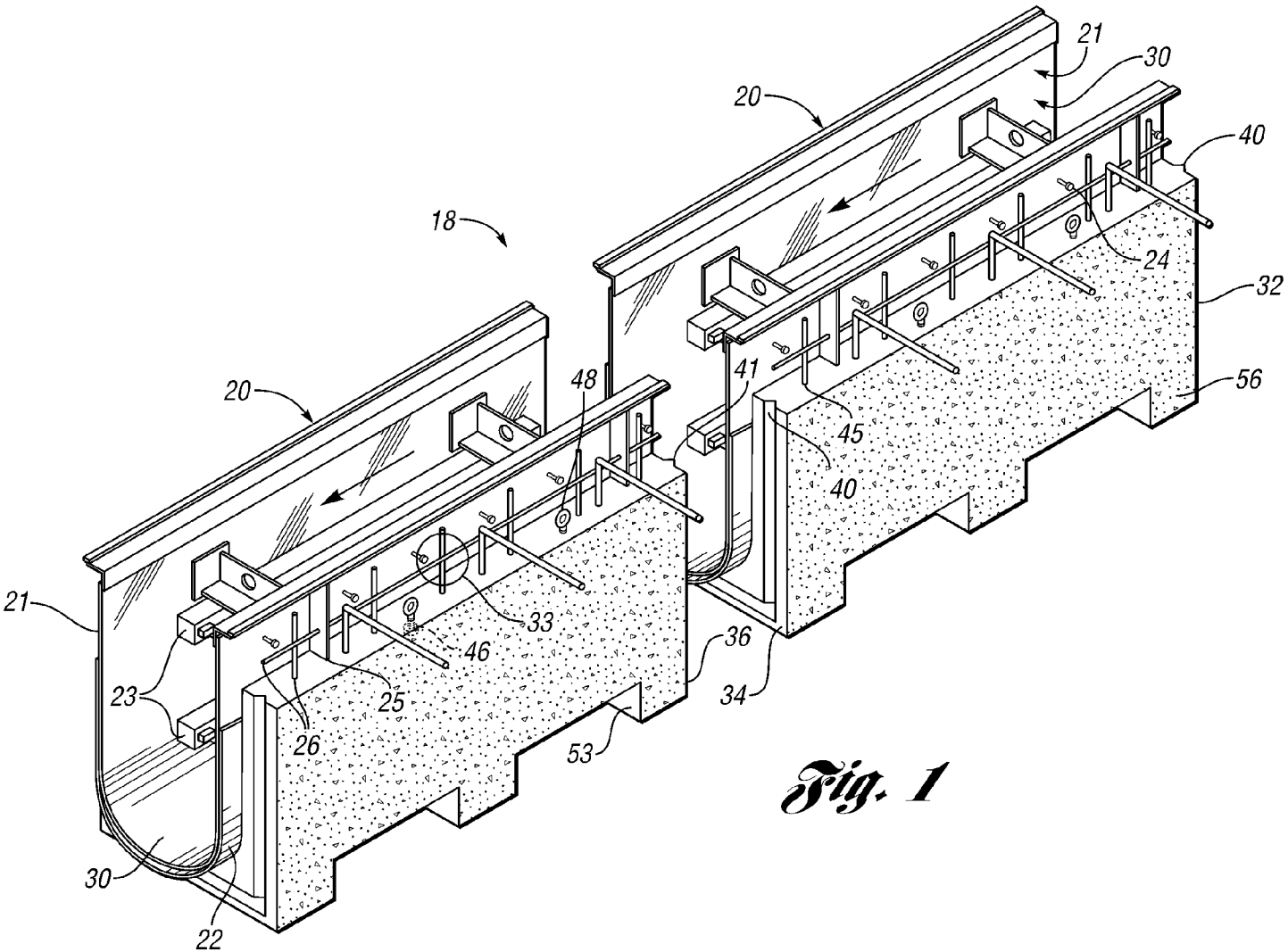
FIG. 1 is a perspective view of one embodiment of precast flume sections being assembled according to the present invention.

Referring first to FIG. 1, a flume 18 differs from most previously known flumes as formed of a plurality of precast flume sections 20. The precasting refers to forming prior to installation in an excavation, although the casting may be remote from or near the excavation site without departing from the invention. Each precast flume section 20 includes a prefabricated steel flume liner 21. The liner 21 may be a metal sheet or molded composite material formed with a channel, preferably, a U-shaped, V-shaped or square bottom channel for simplicity, to form a trough 30. The liner may also be double-walled to form both inner and outer troughs. Removable spacers 23 within the trough and exterior stiffeners 25, for example, angle irons tack welded to the outer surface of the lining, may be attached and located at specific locations on each precast section to withstand flume deformation during the precast fabrication process during which the liner 21 is encased in and integrated with a concrete shell 32. Preferably, the spacers 23 and stiffeners 25 may also be constructed, configured and located to assist handling, shipping, transportation and installation of the sections, although other dedicated handling, shipping, transportation and installation elements may be used without departing from the invention.

During a preferred embodiment of fabrication, anchors 24 are secured to exterior surface locations of the flume liner 21. Anchors may be any protrusions extending from the surface that may become embedded in an adjacent layer such as a shell 32 or an excavation filler. Preferably, the anchors 24 may be in the form of round headed fasteners such as "Nelson" type stud anchors, or flat steel bands with bends to form mud hooks. The exterior stiffeners 25 preferably support a reinforcement frame 33 when additional support for the precast sections is desired during handling, shipping or installation. For example, the stiffener 25 may be a strap of angle iron that includes openings, such as ⅝ inch punched holes to receive reinforcing bars 26, such as ½ inch steel rebar, that form a frame 33 to be embedded in shell 32, although changes in dimensions and configurations of a frame do not depart from the invention.

The frame 33 can be substantially less massive than previous frames used in excavations, and may be substantially less complex and less heavy than excavation frames welded together in excavations for supporting flume liners in a fixed position for concrete pouring into the excavation. Moreover, both the frame 33 and the shell 32 may be thinner or lighter in weight than in excavation supports. Transport may be substantially enhanced by downsizing the members forming frame 33 and thereby lightening the frame, particularly for shorter length flume sections.

After the frame 33 is secured to the liner 21, the liner 21 is then placed into a form 28 (FIG. 2) into which concrete is poured creating a precast concrete shell 32. The length or the width, or both, of each section 20 or the shell 32 may be designed for a particular installation, but these dimensions may also be configured for transport considerations or other criteria considered without departing from the invention. Moreover, the fabrication work, the casting, or both, may be performed in a dedicated production facility and need not be performed on the machinery user's construction site.

Figure 3:
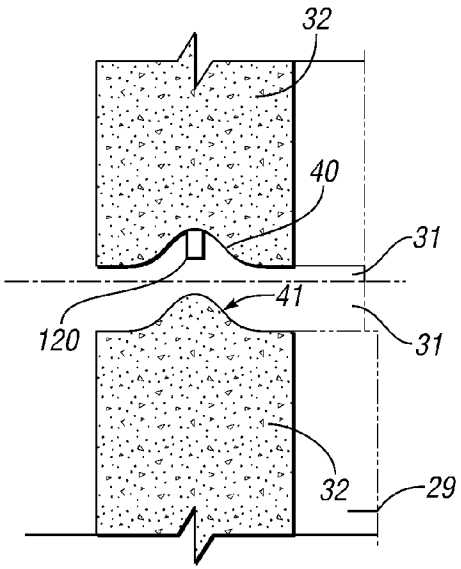
FIG. 3 is an enlarged, fragmentary sectional view of shell portions of adjacent precast flume sections being joined in a flume fabrication stage.
Figure 2:
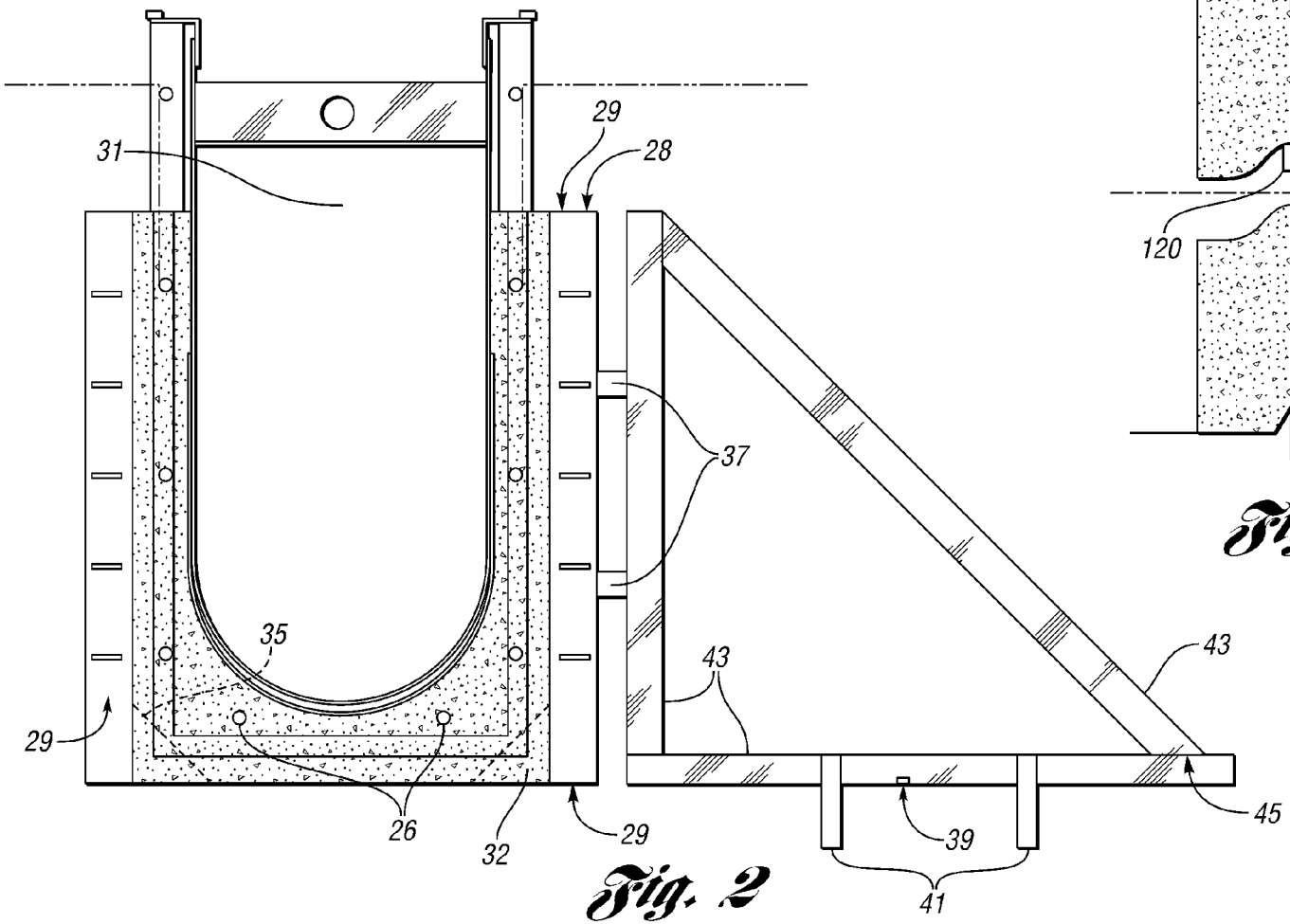
FIG. 2 is a sectional elevation view of a precast flume section of FIG. 1 in a precast fabrication stage.

As best shown in FIGS. 2 and 3, a form 28 includes side wall forms 29 and end wall forms 31 (FIG. 3). Preferably, the wall forms define an exterior shape to a casting cavity and resist deformation during the filling of the cavity with concrete or other flowable composite that can harden to achieve a fixed shape when cured. For example, Symon forms may be used to make the side wall forms 29 and the end wall forms 31. In the preferred fabrication technique, such forms may be reinforced against deformation during forming of the sections 20 by the addition of whalers, preferably in the form of stiffening member, along the length of the wall. The whalers 37 may be supported by a jig 39 mounted by anchors 41 to a base, for example, such as a pouring floor. The jig 39 can be made of simple materials such as 4×4 angle iron cross braces 43 forming a triangular section. Preferably, each triangular section 45 is spaced four to six feet apart from an adjacent at least one triangular section along a ten feet section, although other members, shapes and placements can be used in constructing and supporting forms without departing from the present invention.

As shown in phantom line in FIG. 3, the end forms 31 include configured surfaces for forming a key-way 40 or a corresponding rib 41 at the ends of the shell 32. Similarly, the side walls 29 may include configurations such as protrusions that form the recesses 53 shown in FIG. 1 to reduce the weight of the cast shell 32.

During fabrication of each section 20, one end wall 32 of the form 28 permits one end 22 (pitch end) of the liner 21 to extend beyond the concrete cast or shell 32. The extended portion of the liner 21 can then be positioned for overlapping onto a succeeding section's liner 21. Preferably, the liners 21 of adjacent section 20 is connected, for example, by seam welding. Preferably, the sections 20 are coupled together by welding the seams from within the trough, so that no personnel or equipment must enter, be used in, or removed from the excavation to integrate the flume sections 20 before incasing by flow filling or similar process.

One end 34 of cast shell 32 contains a key-way 40 to align and interlock with a rib 41, other sealing material, or both, to seal an adjoining flume section 36. Steel reinforcing bars 26 may be embedded into the concrete cast shell 32 to permit handling, installation and structural integrity of the embodiment under the surface floor. The reinforcing bars 26 may run through openings in the flanges of angle iron stiffeners 25 as shown in FIG. 1. Nevertheless, the steel reinforcement bars 26 may be aligned in any direction or interconnected in the form of a grid, to form frame 33, so as to reinforce a shell 32 as desired from the standpoint of storage, transport, handling and installing.

Figure 4:
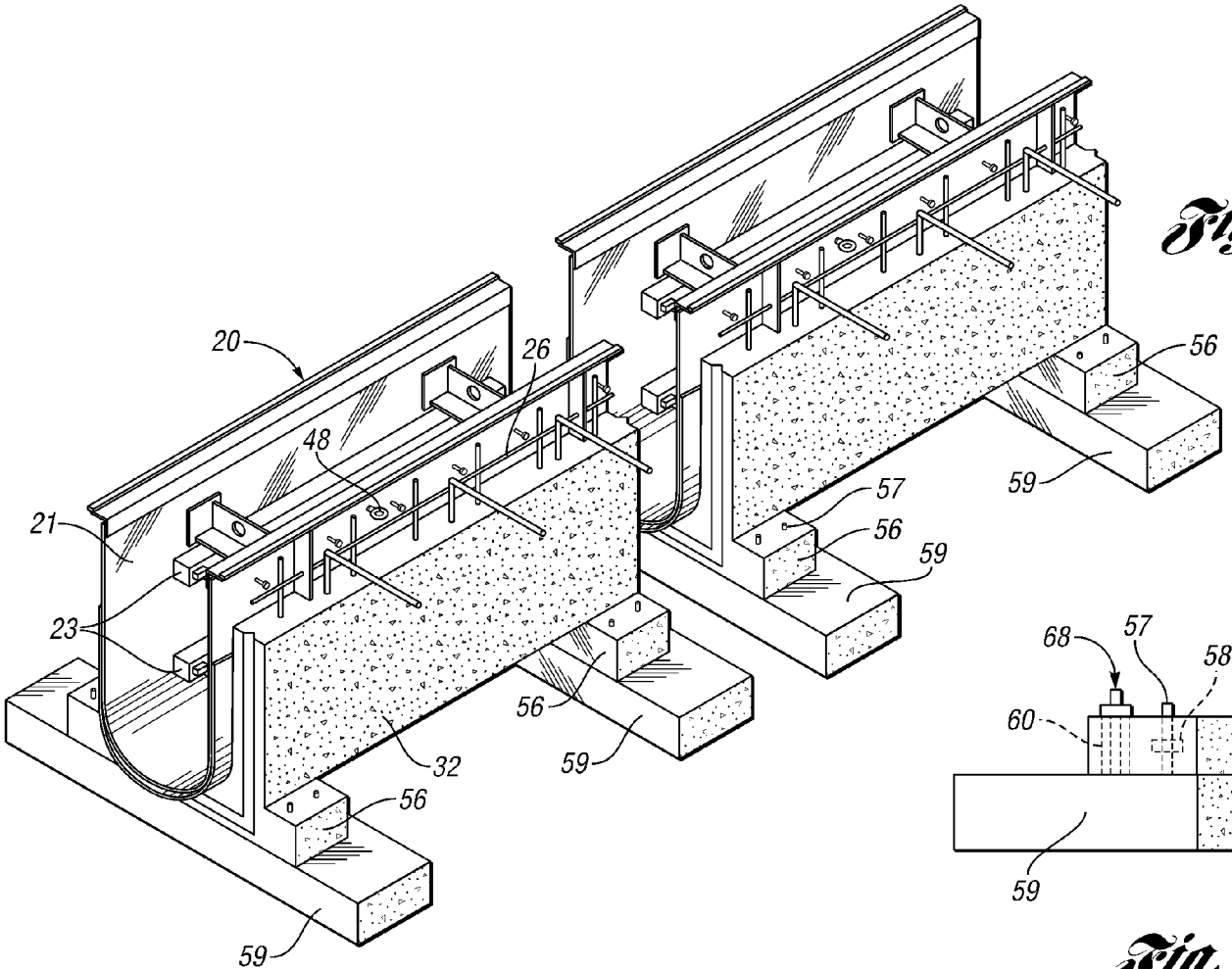
FIG. 4 is a perspective view similar to FIG. 1 showing another embodiment with a modified flume section according to the invention.

Coil threaded inserts 46 (FIG. 1), receiving correspondingly threaded hoisting lugs 48 (FIG. 2), may also be embedded in the cast section 32 (FIG. 1) for handling during shipping or during installation, placement and alignment. As shown in FIG. 4, the lugs 48 may also be exteriorly attached to the liner 21 for cast-in-place mechanical bonding of the shell 32 to frame 33 or to the liner, or may be secured to or formed with the reinforcement bars 26 (FIG. 1).

Figure 7:
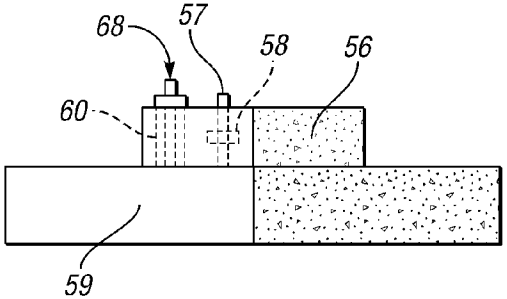
FIG. 7 is an enlarged sectional view of a portion of the flume section shown in FIG. 4.
Figure 9:
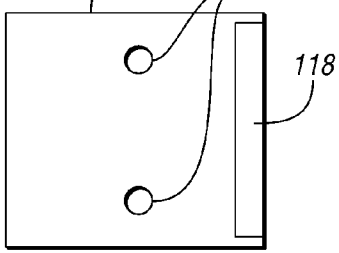
FIG. 9 is an enlarged plan view of a portion of FIG. 8.

One version of a level adjuster 56 that may be fabricated with the section 20 may be viewed in FIGS. 4 and 9. Preferably, leveling bolts 57 (FIGS. 4 and 7), threadably engaged in a sleeve 58 (FIG. 7), embedded in each of four support feet 56 forming a footing 68. In this way, the cast shell 32 provides a type of precision alignment mechanism for adjusting during installation the trough level in the excavation at the height required for the slope of the trough along each section 20 of the flume predetermined for use. The bolts 57 may be extended against any bearing beam 53. Preferably, holes 60 (FIG. 7) in each of the four support feet 56 of the cast section receive alignment fasteners 57 for engagement against footing beams 59 fixing alignment at a proper slope in position within the excavation before incasing is commenced. In this embodiment, the bearing beam 53 is a cast-in-place concrete footing beams 59, or other supports that would be introduced into the excavation, to provide support under each end of the precast flume section 20. The footing mechanism provides an adjustor 56 that facilitates alignment of the liner 21 at a predetermined height, corresponding to a flume slope with respect to the excavation or other benchmark, for maintaining the desired trough slope. Flowable fill, preferably light weight concrete, for example, a concrete including fly ash, may be placed beneath the precast section 20 after alignment, and compacted to ensure no voids exist.

Figure 8:
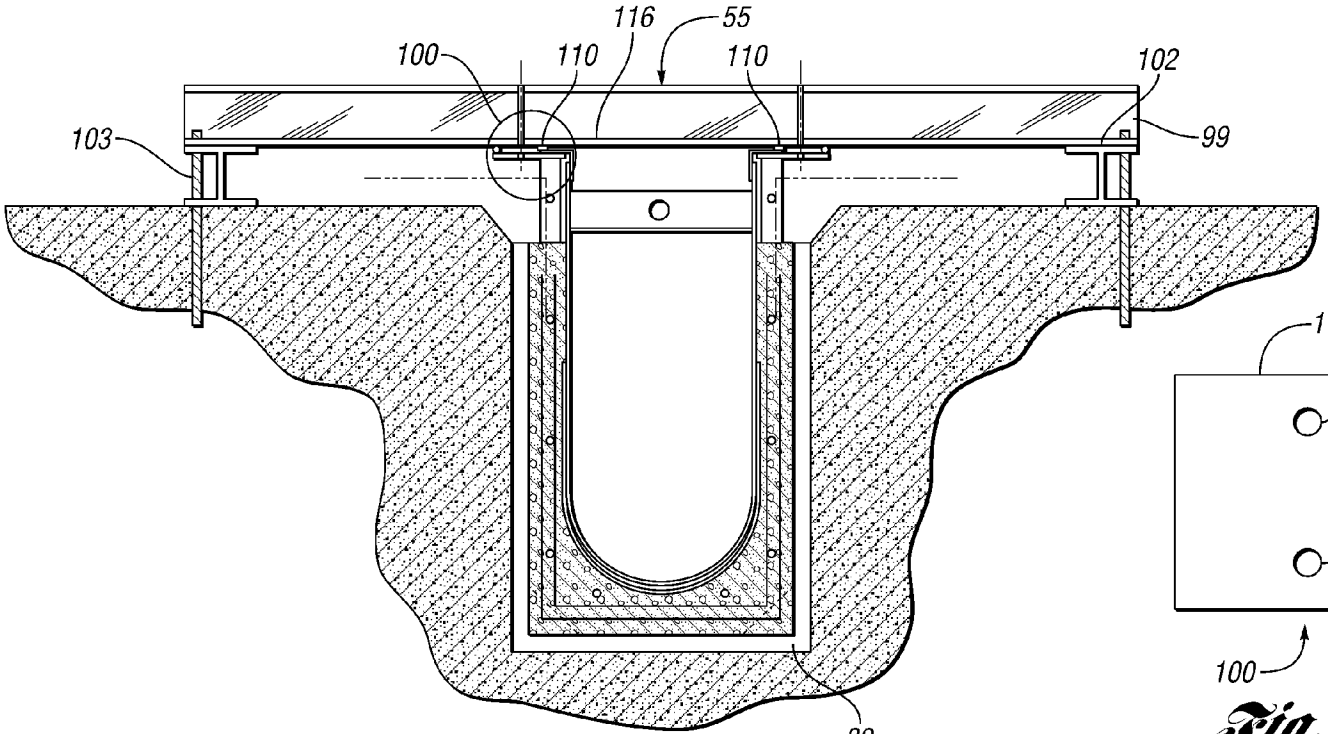
FIG. 8 is a sectional elevation view of the precast flume in FIGS. 2 and 5 being installed by a method embodiment according to the present invention.
Figure 10:
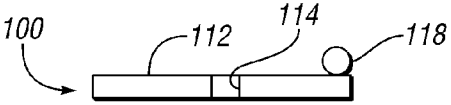
FIG. 10 is an enlarged elevational view of a portion of FIG. 8.
Figure 11:
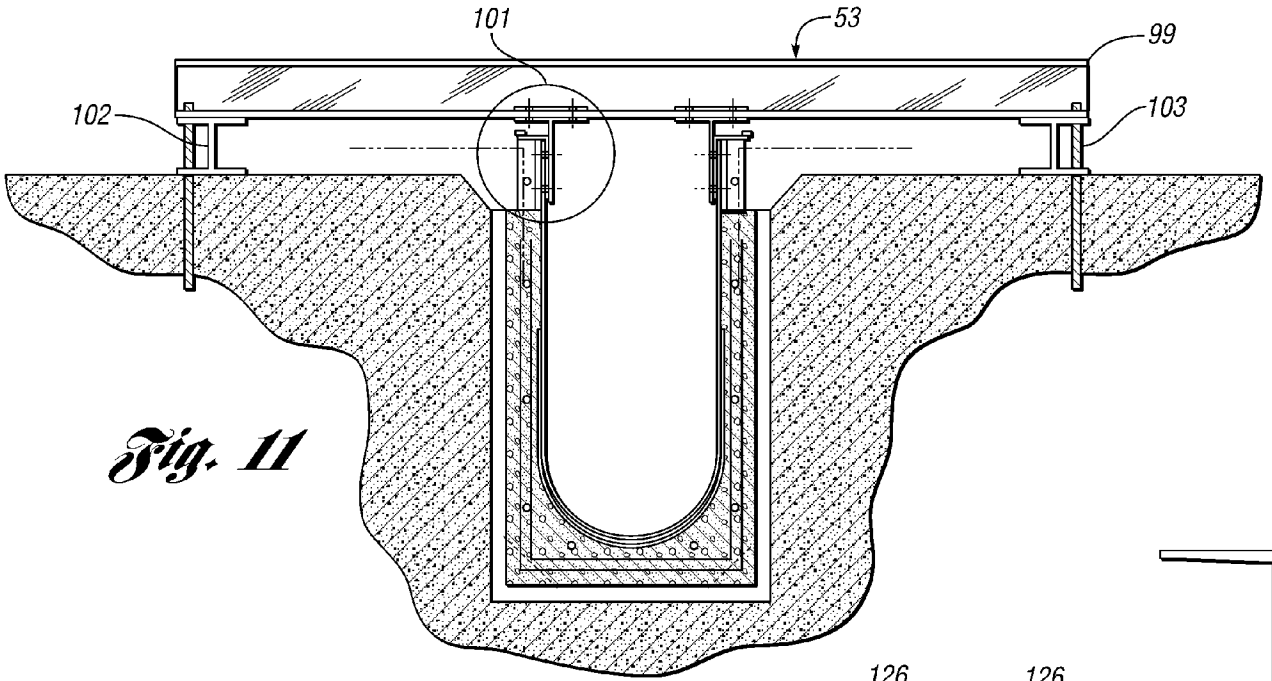
FIG. 11 is a sectional elevation view similar to FIG. 8, but showing a modified embodiment to the method of installation according to the invention.

Another process embodiment preferred to avoid working within or installing supports in the excavation may be practiced by suspending the flume section with an adjustable locator in the form of a spreader beam 55 type of bearing beam 53, shown in FIGS. 8-14. One version used to install the section 20 is to attach two spaced apart spreader beams 99 to the top of precast flume section 20 using flume clamps 100 (FIGS. 8-10) for carrying lighter sections, or clamps 101 (FIGS. 11-14) for carrying heavier sections. Position cribbing beams 102 and retain by hold down spikes 103 (FIGS. 8 and 11). By hoisting beams 55 having clamps carrying precast section 20 into an excavation, the beam 99 may be positioned by hoisting equipment or the like to arrange the liner 21 with respect to a benchmark height by placing spreader beams 99 onto cribbing beams 102 into rough position. Set the section 20 into overlapping relation of extending portion of liner 21 in the previously installed section 20, and fine tune positions of the sections, preferably by arranging shims or the like on the cribbing beams below the spreader beam. Such fine tuning may use vertically aligned jacking screws, or horizontally retrained come-alongs to bring sections together, then tack welding the sections to each other. Once positioned at the benchmarked height and secured in position, excavating may be continued at adjacent areas to position and install additional precast flume sections in sequence if a complete excavation has not been completed.

Precast wall thickness of the shell, reinforcing steel size and location of members in the frame 33 of the precast flume section are designed as required to withstand forces determined by the depth of flume, the depth of the excavation, the manner of transport, storage and handling during installation. For example, the wall thickness of the shell 32 may be substantially reduced over previously known cast-in-place flume constructions. For example, with the reinforcement bar frame 33 to increase rigidity and strength of the flume section 20 during transport and handling, the cast walls may be substantially thinner than the walls poured when the trough was inserted and supported within an excavation during pouring within pouring forms that were previously installed in the excavation.

Figure 5:
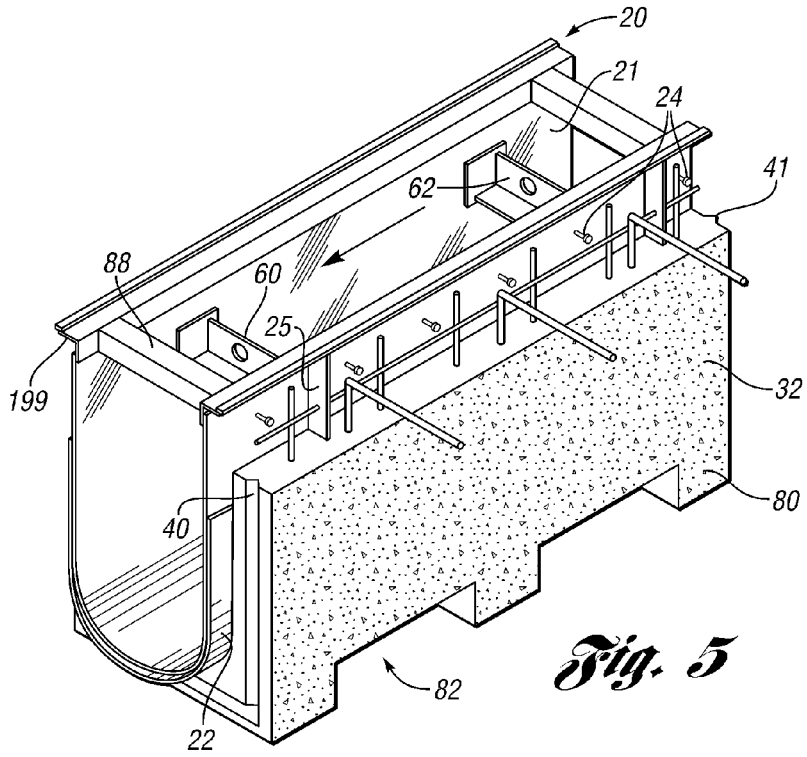
FIG. 5 is an enlarged perspective view of a precast flume shown in FIG. 1.

Moreover, since fabrication of sections 20 can be performed in a facility unrelated to the machinery owner's plant facility, the casting may be configured as shown in FIG. 5 with recesses, preferably created by corresponding mold protrusions carried by the form 28, to assist in handling and lightening the weight of the cast shell 32. For example, with internal reinforcing spacers 23 in the trough, such as spreader 88, and external reinforcement by stiffeners 25 or frame 33 of the concrete shell, such sections 20 may be more readily handled by strapping for hoisting. In addition, the shell 32, as shown with the recesses 82 in FIG. 5, may be conveniently configured for displacement with forklift vehicles. The construction may also substantially improve the portability of the flume sections by modifying the cast-in-place options such as inclusion or placements of the rings 48, or the shapes of the shell 32.

In the embodiment of FIG. 5, the ends of the cast shell design include recesses 82 and a support strip at each end of the recess 82. For example, a strip 10 inches by 7 inches by 18 feet long leaves one foot of the shell at an end to help stabilize the flume during shipping and settling. Bottom elevation of the precast shell is designed so that the flume liner slope will particularly comply with trough specification for the installation, as the bottom of the liner 21 is a predetermined distance from the bottom of the shell 32. By placing the bottom of the shell 32 within a predetermined height within the excavation, for example, either supporting as with the embodiment of FIGS. 5 and 7, or supporting as hoisted at a predetermined height with respect to a benchmark, such as the finish flooring height or machinery foundation surface as shown in FIGS. 8-14, the liner slope of the installed sections can comply with required slope of the trough formed by installed sections at the point of installation.

Referring now to FIG. 5, additional reinforcement may be provided. A spreader 88, for example, an angle iron strut, may be joined to a top edge reinforcement 199, for example, an angle iron. The spreader 88 may be secured to the top of each flume section 20 when additional strength during transport, handling and incasing of the trough is desired to prevent distortion. Also the spreader 88 or top edge reinforcement 99 may remain in place after installation and incasing when, for example, additional support for cover plating is required in heavy traffic areas.

Incasing generally includes filling the cavity 89 (FIG. 8) of the excavation outside of the positioned and secured flume section. Such filling may be accomplished with flow fill, a fast flowing concrete mix, for example, mixed with fly-ash. Incasing may also include backfilling with dirt removed from the excavation. Incasing may also include other concrete filling material or other compactable material suitable for in floor support. Preferably, flow fill or back fill compressible by compaction is most easily performed by filling and compacting within the excavation on one side of the flume section before filling and compacting fill on the other side of the flume section 20.

In an installation method embodiment as shown or modified, excavation at the installation site preferably begins with a flat compacted subgrade 8 inches to 18 inches below finish floor level or machinery foundation surface. The center line along the transfer route is laid out, and fabricated precast flume sections 20 are delivered to the job site and arranged along the route, for example, about 10 feet from the center line. By computing excavation elevations, and predetermined height of the liner 21 with respect to any benchmark desired to be used, installation of each section preferably begins at the deepest elevation or discharge point along the route. The excavation may be a straight banked excavation, and may be only 2 inches to 4 inches wider than the precast flume sections 20. All excavated soil may be loaded directly into a dump truck to be immediately removed from the work area if not required for backfilling.

Figure 6:
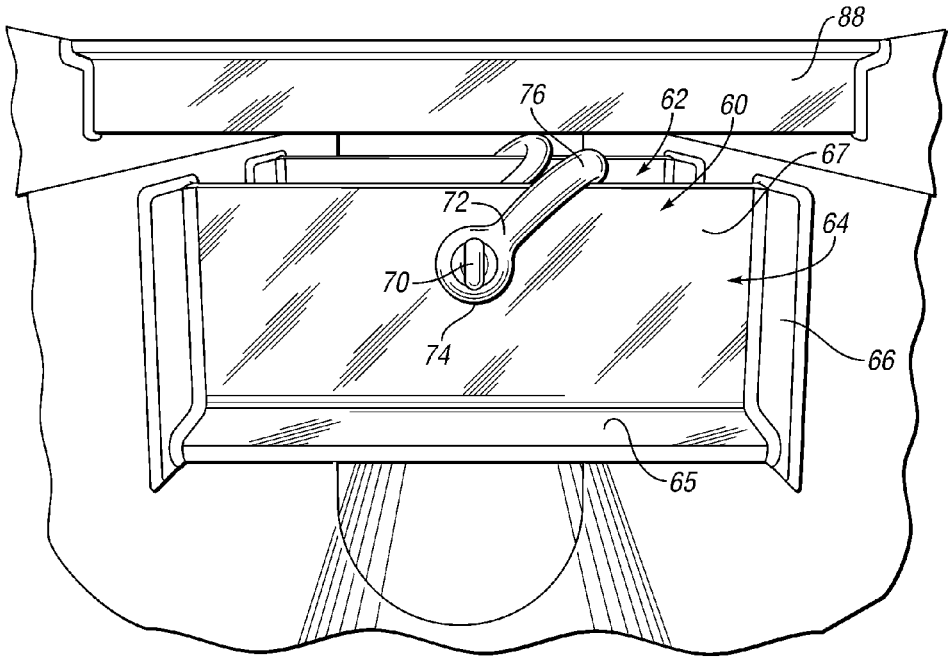
FIG. 6 is an enlarged elevation of interior features that may be employed in casting and handling of flume sections constructed according to the invention.

During fabrication of each section 20, the liner 21 may be reinforced against displacement during pouring both by the external components such as the frame 33 and interior components such as one or more spreaders 23 such as the spreader 88. As also shown in FIG. 6, the spreader bar may be configured to serve as a hoist bar 60 during installation of the completed section 20 within an excavation. Two such spreader bars 60 and 62 are shown in FIG. 6. Spreader bars 60, 62 may be identical, or as shown, mirror images of each other, although the actual shape or design is variable, so long as the spreader bars are rigid enough and positioned for balancing the weight of each flume section 20 for hoisting, transport or handling for installation into an excavation as required for the project.

In the illustrated embodiment, the spreader may be a ½ inch thick cross angle 64 with flange 65, for example 4 inches wide, and flange 67, for example 6 inches wide, may be secured to end plate 66 at each end by welds or the like. The end plates 66 are then welded at their peripheral edges to the inner surface of the side walls of the lining 21. Peripheral welding of the end plates 66 may spread out the force being applied to the walls as lifting forces and pressure are exerted upon the spreader bars 60 and 62 during hoisting. Moreover, after installation in the excavation, the spreader bars 60 and 62 may be removed by grinding the welds at the periphery of each end plate 66, so as to release the hoist bars for removal. Such bars may be reused by reinstallation in another section 20.

As also shown in FIG. 6, the cross bar 64 may be thicker than the end plate 66, or have a reinforced opening, so as to engage a lift pin 70 along a substantial portion of the length of the pin, to resist deformation of the pin 70 during hoisting. The pin may in turn be engaged by shackle 72 having ear holes 74 that engage the ends of the pin 70. The pin may be selectively locked, for example, by cotter pins, within the ear holes 74 of the shackle 72. The main body 76 of the shackle 72 may then be engaged by a hook or other hoisting strap. Such attachments for hoisting and installation of the flume sections 20 may maintain the section 20 in a fixed, hoisted position while incasing of the excavation continues beneath the cribbing supported flume sections. This procedure avoids the need for manually or otherwise physically restraining the section 20 from within the excavation while properly defining the slope and height of the flume trough at that section.

When the flume section 32 is hoisted and positioned by a crane or other tool into the excavation, rough positioning of the flume section by the tool may be sufficient, although manual redirection or force may be applied as necessary to assure that the extended liner portion is aligned with the overlapping portion of an adjacent section previously laid. Then, before releasing the hoist, incasing of the section within the excavation is commenced to support the section liner at the predetermined height in the excavation, without requiring manual labor to be performed within the excavation. Personnel need only enter the trough, reinforced both externally and internally, to weld or otherwise secure one extended portion of the liner to the overlapped portion of the adjacent section 20. Preferably, the spreaders are removed after connection of the sections and incasing of the excavation.

In FIGS. 8-10, the upper angle iron 199 (FIGS. 5, 8) may be provided with a rectangular bar stop 110 that forms an edge for retaining a protective plate over the top of the trough while machinery is being assembled over the flume. A clamp 100 includes a plate 112 (FIG. 10) provided with apertures 114 for receiving a bolt extended through the plate 14 and the lower flange 116 (FIG. 8) of the beam 99. The bolt is retained by a nut to grip or clamp the lip formed by a flange of the angle iron 199. A match bar 118 matching the gap height set by the bar stop 110 enables the clamping plate 112 to lie flat under the bolt head of the bolt that is retained by a nut above the top surface of the I-beam flange 116.

Figure 12:
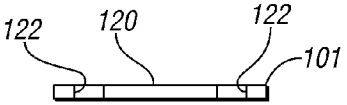
FIG. 12 is an enlarged elevational view of a part of FIG. 11.
Figure 13:
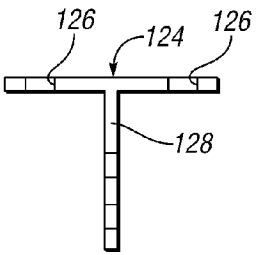
FIG. 13 is an enlarged elevational view of a part of FIG. 11.
Figure 14:
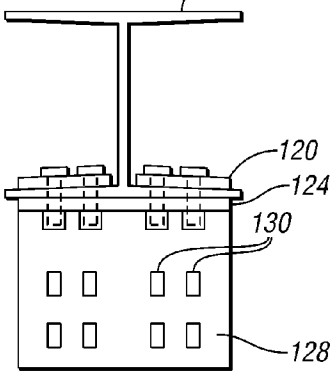
FIG. 14 is an enlarged side view of the parts shown in FIGS. 12 and 13.

In the clamp 101 embodiment, as shown in greater detail in FIGS. 12-14, the clamp 101 includes a pair of upper plates 120 over opposing flanges 116 of the I-beam 99. Each plate 120 is provided with apertures 120 adapted to receive a bolt for engaging the upper clamp plate 120 with a lower clamp tee 124 (FIG. 13). Similarly, the lower tee clamp body 124 includes apertures aligned similarly to the apertures 122, while a stem portion 128 includes apertures adapted to receive bolts that are extended through upper portions of the liner section 21 or the support structure for handling and installation of the flume section. The openings 130 in the stem of the tee 128 are preferably elongated as shown in FIG. 14 so as to provide some adjustment for variations in construction for each flume section 20 and variation in the shims used to position the bearing beam 99 above the cribbing beam 102 to fine tune the bearing beam's position with respect to a benchmark.

Before final positioning of a section 20, and more preferably before hoisting, a seal material, for example, Bentonite, is applied into key-way 40 as shown at 120 in FIG. 3. Preferably, a series of tabs or a continuous bead of material, such as Rx Brand vituminous clay, or other seal that expands in contact with fluid, form a seal at key 41 to match the key-way 40 in the adjacent section 20. Final adjustment of the newly introduced flume section to an adjacent previously positioned section may be performed by using jacking screws, come-alongs or other mechanical aids, preferably while hoisted. When a section 20 is positioned with an extended liner portion overlapping the adjacent section 20, the liners are tack welded into position, repeating the recited steps for the subsequent flume sections. Preferably, both tack welding and final welding of flume sections together may also be accomplished by welders working on the "inside" of the flume protected from the excavation.

Preferably, at the end of a day's assembly of sections, a temporary plywood bulkhead, for example, plywood cut to shape to dam the excavation outside of the section 20, is installed at the open end of the flume (high point). Incasing holds the bulkhead in place. Preferably, flow-filling settles in the trench to complete incasing and locking sections 20 into final position. After settling the fill, for example, waiting until the flow-fill cures, for example, the following morning, spreader beams and cribbing beams may be removed unless retained for supporting temporary cover plates. The subsequent day's installation begins at the bulkhead, by excavating the next receiving section, to restart the installation cycle.

While preferred embodiments and some variations have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for constructing machinery flumes comprising:

fabricating a plurality of flume sections, each of said plurality of sections having at least one flume lining forming a channel and a rebar frame external of said channel;

precasting a concrete sheath over said lining and said rebar frame of each section, a portion of said at least one lining portion extending beyond an end of said form, and coupling a first section of said plurality of sections by positioning said extending portion of said first section lining to overlay an end of a second of said plurality of flume sections, and by joining said extended portion overlay in said channel of said second flume section.

2. The invention as described in claim 1 wherein said lining includes a primary wall and a secondary wall.

3. The invention as described in claim 1 wherein said positioning includes lowering said first and second sections in an excavation.

4. The invention as described in claim 3 wherein said lowering comprises hoisting a spreader beam.

5. The invention as described in claim 4 wherein said spreader beam is an I-beam.

6. The invention as described in claim 1 and wherein said precasting including embedding anchors on said concrete layer.

7. A flume comprising:

a plurality of flume sections, each section having a lining supported in a reinforcement frame embedded in a precast concrete layer, and having an end of said lining extending beyond an edge of said precast concrete layer, an edge of said precast concrete layer having a key-way, an opposite edge of said precast concrete layer having a keying rim, an end to end alignment of precast concrete sections and a seal embedded between said edge of said precast concrete layer and said opposite edge of said precast concrete layer adjacent to said edge.

8. A flume as described in claim 7 and further comprising an excavation receiving each said flume section, said excavation having a width not substantially more than the width of said sections.

9. A method for constructing machinery flumes comprising:

constructing a plurality of flume sections;

each of said plurality of sections having at least one flume lining forming a channel;

securing said lining to a frame having a predetermined footing dimension below the channel;

precasting a concrete sheath about said lining and imbedding said frame, in a form, a portion of said at least one lining portion extending beyond one end of said sheath, coupling a first precast section by positioning said extending portion to overlap an end of a second precast section.

10. The invention as described in claim 9 wherein said predetermined footing dimension of said first precast section and said predetermined footing dimension of said second precast section comply with a predetermined slope for the flume lining.

11. The invention as described in claim 9 and comprising installing said first and second precast sections in an excavation.

12. The invention described in claim 11 and comprising supporting said first and second precast sections by backfilling said excavation.

13. A method for constructing machinery flumes by installing precast sheathed, flume liner sections in an excavation, comprising:

installing at least one rigid support across the channel of the liner of each said precast sheathed section;

suspending said precast sheathed section by lifting said at least one rigid support; and lowering said precast sheathed section into an excavation to position said liner at a predetermined height with respect to a benchmark; and further comprising lowering a second precast sheathed section having an extended liner portion adjacent said first precast sheathed section so that said extended liner portion overlaps said first precast sheathed section liner.

14. The invention as described in claim 13 wherein said precast sheathed section includes an embedded frame, and wherein said frame includes a footing at a predetermined dimension from said liner.

15. The invention as described in claim 13 and comprising joining said extended portion to said overlapped portion in said channel.

* * * * *